US005459491A

United States Patent [19]

Takeuchi et al.

[11] Patent Number: 5,459,491

[45] Date of Patent: Oct. 17, 1995

[54] THERMAL HEAD

[75] Inventors: Yukihisa Takeuchi, Nishikamo; Toshikazu Hirota, Nagoya, both of Japan

[73] Assignee: NGK Insulators, Ltd., Japan

[21] Appl. No.: 170,930

[22] Filed: Dec. 21, 1993

[30] Foreign Application Priority Data

Dec. 23, 1992 [JP] Japan ..... 4-357502

[51] Int. Cl.[6] ..... B41J 2/335

[52] U.S. Cl. ..... 347/201

[58] Field of Search ..... 346/76 PH, 139 C, 346/155

[56] References Cited

U.S. PATENT DOCUMENTS

| | | | |
|---|---|---|---|
| 5,101,221 | 3/1992 | Takeuchi et al. | 346/76 PH |
| 5,132,705 | 7/1992 | Takeuchi et al. | 346/76 PH |
| 5,260,717 | 11/1993 | Takeuchi et al. | 346/76 PH |

FOREIGN PATENT DOCUMENTS

| | | | |
|---|---|---|---|
| 0496596 | 7/1992 | European Pat. Off. | B41J 2/395 |
| 4-226766 | 8/1992 | Japan . | |

OTHER PUBLICATIONS

Patent Abstracts of Japan, vol. 11, No. 158 (M-591) (2605) May 22, 1987.

Patent Abstracts of Japan, vol. 8, NO. 182 (M-319) (1619) Aug. 22, 1984 & JP-A-59 073 973 (Nippon Denki K.K.) Apr. 26, 1984.

Handbook for Recording/Memory Technology, Kokado et al., Aug. 25, 1992 pp. 328-329.

*Primary Examiner*—Huan H. Tran

*Attorney, Agent, or Firm*—Parkhurst, Wendel & Rossi

[57] ABSTRACT

A thermal head for printers, facsimile machines, copying machines, etc., of the thermo-sensitive type or thermo-transfer type, includes a substrate and a resistance-heating element on the substrate. The substrate has a printing surface relative to which an information carrier is caused to slide for printing information on the information carrier. The substrate comprises a material having a thermal conductivity coefficient and a heat capacity per unit volume which are within respectively defined numerical ranges. The resistance-heating element is formed on a thin-walled portion of the substrate, and the printing surface is made integral with a substrate surface which is adjacent to the resistance-heating element.

17 Claims, 2 Drawing Sheets

THERMAL HEAD

BACKGROUND OF THE INVENTION

1. Field of the Invention

The present invention relates to a thermal head which can be suitably used for printers, facsimile machines, copying machines, etc., of a thermo-sensitive or thermo-transfer type.

2. Description of the Related Art.

Various types of thermal heads have been proposed and practically used for printers, facsimile machines, copying machines, etc., of a thermo-sensitive or thermo-transfer type. For example, a flat type thermal head is known in which a substrate has a printing surface which is formed thereon with a resistance-heating section and arranged co-planar with a surface region provided with a driver IC for driving the heating section. An end-face type thermal head is also known in which a resistance-heating portion is provided on the end-surface of a substrate which is perpendicular to a plane provided therein with a driver IC. In many cases, the arrangement of the printing surface of known thermal heads is such that alumina or the like ceramic substrate having a grazed layer is provided thereon with a heating element in the form of an array of a plurality of resistance bodies. The heating element is provided with electrodes to be connected to an electric power source and covered by a protective surface layer for preventing a premature wear of the resistance-heating element, and such surface layer is typically composed of silicon nitride or glass. In this connection, reference may be had to "Handbook for Recording/Memory Technology" edited by Kokado et al, and published on Aug. 25, 1992 by Maruzen Publisher, Japan, pages 328–329, the disclosure of which is incorporated herein by reference.

With the known thermal heads discussed above, for successively printing information on information carrier, e.g., a sheet of thermo-sensitive paper or ordinary paper, the information carrier and possibly an ink ribbon film is brought into pressure contact with the thermal head by a platen roller and caused to slide over the resistance-heating element in tangential or circumferential direction of the platen roller, with the protective surface layer between the information carrier and the heating element. In this instance, the application of pressure by the platen roller is to ensure that the heat generated by the resistance-heating element on the head substrate is effectively utilized for thermal print recording of information.

Although the protective surface layer on the printing surface does serve to provide the resistance-heating element with a certain degree of durability, formation of the protective surface layer not only requires complicated production steps and a relatively high manufacturing cost, but also makes it difficult to increase the printing speed due to deterioration with time in the thermal characteristic of the head. Moreover, because the thermal head is continuously maintained in a sliding pressure contact with the information carrier during operation, the durability of the protective layer tends to be insufficient particularly in the case of a heavy duty use as in a bar-code printer. Such insufficient durability often results in damage to the resistance-heating element and malfunctions of the thermal head, e.g. lack and/or dislocation of dots which form a desired code or character to be printed.

DESCRIPTION OF THE INVENTION

The present invention has been conceived with an objective to overcome the above-mentioned problems and to provide an improved thermal head which achieves a superior thermal response and a high energy consumption efficiency, which is highly reliable in operation and which can be produced at a relatively low cost.

Briefly stated, the thermal head according to the present invention comprises a substrate and a resistance-heating element formed on the substrate and adapted to be supplied with electrical power. The substrate comprises a material having a thermal conductivity coefficient within a range of 0.0025 to 0.030 cal·cm/sec·cm$^2$·°C. and a heat capacity per unit volume of 0.55 cal/°C.·cm$^3$ or less. The substrate has a thin-walled portion which is formed with the resistance-heating element and which is thinner than remaining portions of the substrate. Further, the substrate has a printing surface relative to which an information carrier is caused to slide for printing information on the information carrier. The printing surface is made to be integral with a substrate surface which is adjacent to the resistance-heating element.

According to the present invention, the substrate supporting the resistance-heating element is formed of a material having specifically defined numerical ranges of thermal conductivity coefficient and heat capacity per unit volume. The advantages achieved by the particular ranges of the substrate material in accordance with the present invention will be explained below.

First, the substrate material has a thermal conductivity coefficient within a range of which the lower limit is higher than that of glass or the like material with a relatively low thermal conductivity coefficient. Thus, the heat generated by the resistance-heating element can be rapidly conducted through the substrate effectively to perform the thermal printing and recording. Particularly in a high speed recording, the amount of heat remaining after recording can be rapidly dispersed through the substrate to minimize undesired tailing and the like as a result of heat accumulation. It has been confirmed that, when the thermal conductivity coefficient of the substrate material is less than 0.0025 cal·cm/sec·cm$^2$·°C., the heat generated by the resistance-heating element does not reach the substrate rapidly and it is therefore difficult or impossible to perform an effective thermal printing and recording. It has been further found that the substrate material provides an excellent performance when the thermal conductivity coefficient is 0.003 cal·cm/sec·cm$^2$·°C. or more.

Second, the substrate material has a thermal conductivity coefficient within a range of which the upper limit is lower than that of conventional material such as alumina, metal and the like with a relatively high thermal conductivity coefficient. Thus, when heat is generated by the resistance-heating element in operation of the thermal head, it is possible to prevent unnecessary amount of heat from being dissipated to the substrate, thereby to realize a recording with a high energy consumption efficiency. It has been confirmed that, when the thermal conductivity coefficient of the substrate material is higher than 0.030 cal·cm/sec·cm$^2$·°C., an unnecessary amount of heat is dissipated to the substrate to lower the energy consumption efficiency. It has been further found that the substrate material provides an excellent performance when the thermal conductivity coefficient is 0.010 cal·cm/sec·cm$^2$·°C. or less.

Third, the substrate can be formed to have a minimized volume while maintaining the desired mechanical strength. The substrate with a minimized volume and a small heat capacity per unit volume serves to realize a thermal head with a high recording sensitivity and an improved response characteristic, which can be rapidly heated-up and cooled-down. It has been confirmed that, when the substrate material has a heat capacity in excess of 0.55 cal/°C.·cm$^3$, the thermal head is difficult both to heat-up and cool-down and does not provide a sufficiently high recording sensitivity and a satisfactory response characteristic. It has been further found that the substrate material provides an excellent performance when the heat capacity per volume is 0.53 cal/°C.·cm$^3$ or less.

According to the present invention, furthermore, the information carrier is maintained in a pressure sliding contact with that surface portion of the substrate which is adjacent to the resistance-heating element. As a result, the resistance-heating element is prevented from a direct contact with the information carrier and it is thus unnecessary to provide the protective surface layer. Moreover, the heat generated by the resistance-heating element is conducted to the printing section through a thick-walled portion of the substrate to enable thermal printing on the information carrier. The heat generated by the resistance-heating element can be utilized without being dissipated to the protective layer.

Preferably, the resistance-heating element is formed on that side of the substrate which is opposite side to the printing surface. This ensures that the resistance-heating element can be formed directly on the rear surface of the substrate, and the heat generated by the heating element can be efficiently conducted to the printing surface through the substrate to achieve an effective thermal printing and recording.

Preferably, the substrate comprises a glass ceramic material. Such a material can be readily machined to form efficiently form the thin-walled portion for mounting the resistance-heating element, and does not require formation of a glazed layer between the substrate and the resistance-heating element, which has conventionally been provided in view of the thermal efficiency. Moreover, it becomes possible to avoid malfunction of the thermal head in terms of printing characteristic, due to a thickness fluctuation of the glazed layer, which has been a particular problem in a machined substrate.

Preferably, the resistance-heating element is spaced from the printing surface of the substrate by a distance within a range of 0.02 to 0.3 mm. By this, in cooperation with the substrate having the above-mentioned thermal conductivity coefficient and heat capacity per unit volume, the resistance-heating element can perform an optimum printing.

Preferably, the thermal head further comprises a reinforcement member which is provided along the thin-walled portion of the substrate. The reinforcement member may be arranged on the thin-walled portion of the substrate, and may have a shape which conforms to the thin-walled portion of the substrate. The reinforcement member serves to provide a substrate having an improved mechanical strength of the thin-walled portion.

Preferably, a heat radiating means is provided adjacent to the resistance-heating element. The heat radiating means may comprise a heat radiation space or a heat radiator. By this, the heat which has not been used for printing can be rapidly dispersed to minimize undesired tailing and the like during a high speed printing.

Preferably, the heat radiator is connected to the resistance-heating element through a reinforcement member. By this, it is possible to improve the mechanical strength of the thin-walled portion of the substrate, while ensuring that the heat which has not been used for printing can be rapidly dispersed to minimize the tailing and the like during a high speed printing.

BRIEF DESCRIPTION OF THE DRAWING

The present invention wall be further explained in detail with reference to specific embodiments shown in the accompanying drawings, in which.

DESCRIPTION OF THE PREFERRED EMBODIMENT

Figure 1:
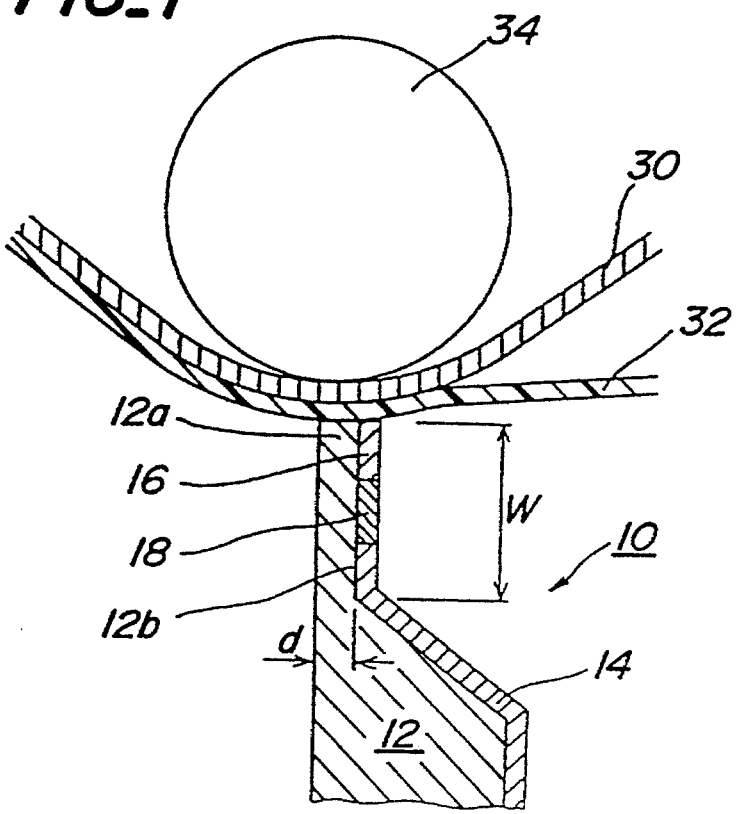
FIG. 1 is a sectional view showing a thermal head according to a first embodiment of the present invention.

There is shown in FIG. 1 a thermal head according to the first embodiment of the present invention, which is designated as a whole by reference numeral 10. The thermal head 10 includes a substrate 12 which has been subjected to a one-sided surface cutting to form a tip end of a reduced thickness "d" of 0.3 mm, for example, which may be referred to as a "thin-walled portion". The tip end of the substrate 12 serves as a printing section **12*a* with which an information carrier 30, e.g., a sheet of ordinary paper, and an ink ribbon film 32 are maintained in a pressure sliding contact by means of a platen roller 34. The substrate 12 has a cut surface 12*b* which is provided with a resistance-heating element 18. The heating element 18 is formed of an array of resistance-heating bodies which are arranged in the printing width direction which is perpendicular to the sheet of FIG. 1. For supplying electric power to the resistance-heating element 18, the resistance-heating element 18 has upper and lower portions which are electrically connected to a recording electrode 14 and a common electrode 16, respectively. The recording electrode 14 may be connected to a driver IC, not shown, in a manner known, per se. The cut surface 12*b* shown in FIG. 1 has an inclined surface forming an obtuse angle relative to the general surface of the substrate 12. However, the cut surface 12*b*** may have different shape, such as an inclined surface with an acute angle, a right-angled surface providing a stepped shape, or a curved surface with a rounded shape.

The substrate 12 is composed of a material having a thermal conductivity coefficient within a range of 0.0025 to 0.030 cal·cm/sec·cm$^2$·°C., preferably within a range of 0.003 to 0.010 cal·cm/sec·cm$^2$·°C., and a heat capacity per unit volume of 0.55 cal/°C.·cm$^3$ or less, preferably 0.53 cal/°C.·cm$^3$ or less. Advantageously, the substrate 12 is composed of a glass ceramic material having an excellent machining characteristic. The resistance-heating element 18 may be formed of a thin-film or a thick-film resistor, preferably exhibiting a high heat pulse durability characteristic and a high resistance value. The resistance-heating element 18 may be composed of (i) a material of which the main component comprises a metal having a high melting point or its alloy; (ii) a material of which the main component comprises a mixture of a metal having a high melting point or its alloy with oxide, nitride, boride, or carbide; (iii) a material of which the main component comprises nitride, carbide, boride or silicide of at least one member selected from a group of titanium, tantalum, chromium, zirconium, hafnium, vanadium, lanthanum, molybdenum, tungsten and the like; or (iv) a material of which the main component comprises a ruthenium series oxide and the like. The material used for the resistance-heating element 18 may have a desired pattern which has been formed by ordinary procedures depending upon the desired recording density of the head, or may be in the form of a continuous strip. An ordinary conductive material is used as the recording electrode 14 and the common electrode 16, which may be suitably selected from metals such as chromium, titanium, molybdenum, tungsten, nickel, gold, copper, silver, palladium and the like, or alloys or nitride, carbide, boride and the like of those metals.

The printing section 12*a* provides a printing surface where the tip end surface of the substrate 12 is brought into a pressure sliding contact with the recording paper 30 and the ink ribbon film 32 by a platen roller 34. Of course, when the recording paper 30 is a thermo-sensitive paper instead of an ordinary paper, the ink ribbon film 32 is not required. Whenever a printing command signal is supplied to the driver IC, not shown, heat is generated by the resistance-heating element 18 and conducted to the printing surface through the thin-walled portion 12*a* to perform the desired thermal printing and recording. Preferably, the thin-walled portion 12*a* of the substrate 12 formed with the resistance-heating element 18 has a width W of 3 mm, for example, which is measured in a direction perpendicular to the printing width direction.

Figure 2:
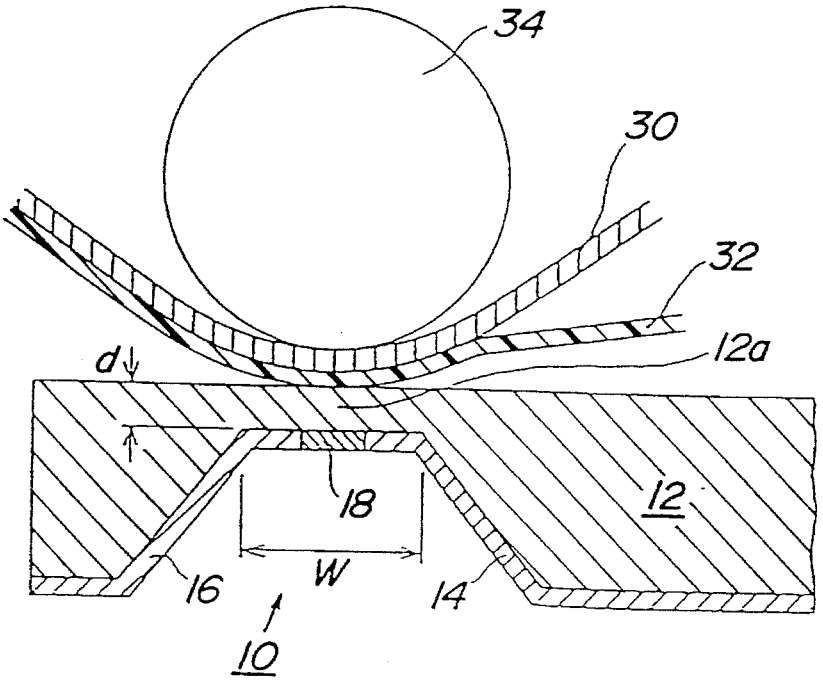
FIG. 2 is a sectional view showing a thermal head according to a second embodiment of the present invention.

Another embodiment of the present invention is shown in FIG. 2, wherein the printing surface of the printing section 12*a* is set on outer surface side of the substrate 12, and the inner surface side of the substrate 12 is formed as a groove having a bottom which is provided with the resistance-heating element 18. By forming the groove, the printing section 12*a* of the substrate 12 has a reduced thickness "d" which is as small as 0.2 mm, to form a thin-walled portion. The groove extends in the direction in which the array of the resistance-heating bodies are arranged. The thin-walled portion, i.e., the printing section 12*a* of the substrate 12, has a width W of 5 mm. As in the previous embodiment, the heat generated by the resistance-heating element 18 is conducted to the printing surface on the opposite side through the thin-walled portion 12*a*, to perform effectively a desired thermal printing and recording on the recording paper 30.

Since the resistance-heating element 18 is not arranged on the printing surface maintained in a pressure sliding contact with the recording paper 30 and possibly the ink ribbon film 32, the resistance-heating element 18 does not require the conventional protective surface layer, and the resistance-heating element 18 exposed on the rear side of the thermal head can be readily accessed from outside to facilitate occasional repair of the connection to the recording electrode 14 or the common electrode 16 even during operation.

In the present embodiment, the end portion of the substrate 12 provides a flat surface for facilitating electrical connection to the common electrode 16, though the connection can be performed using a substrate which is similar to that shown in FIG. 1. Furthermore, as in the previous embodiment, the printing surface 12*a* may be placed on the outer end surface of the substrate 12, with the resistance-heating element 18 provided on the bottom surface of the groove on the side surface of the substrate 12, so that the resistance-heating element 18 is positioned on the back side of the printing surface.

Figure 3:
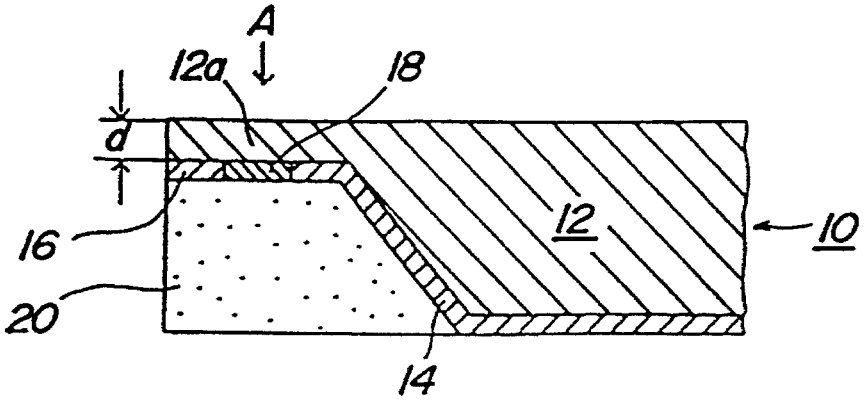
FIG. 3 is a sectional view showing a thermal head according to a third embodiment of the present invention.
Figure 4:
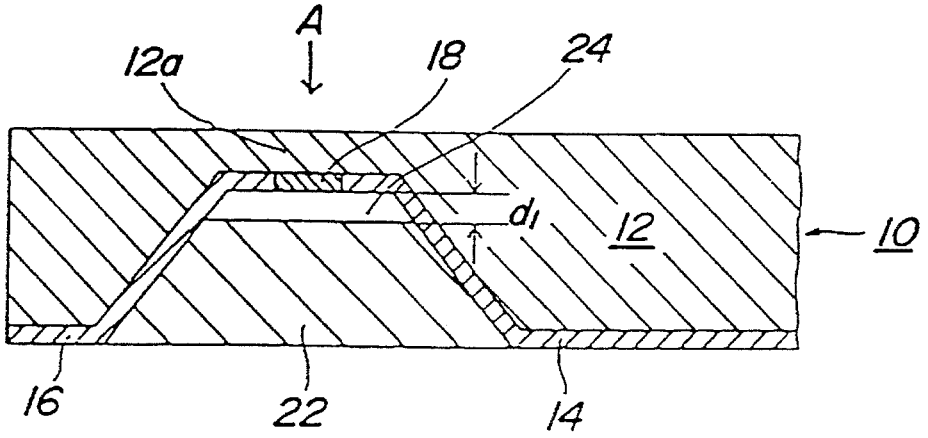
FIG. 4 is a sectional view showing a thermal head according to a fourth embodiment of the present invention.
Figure 5:
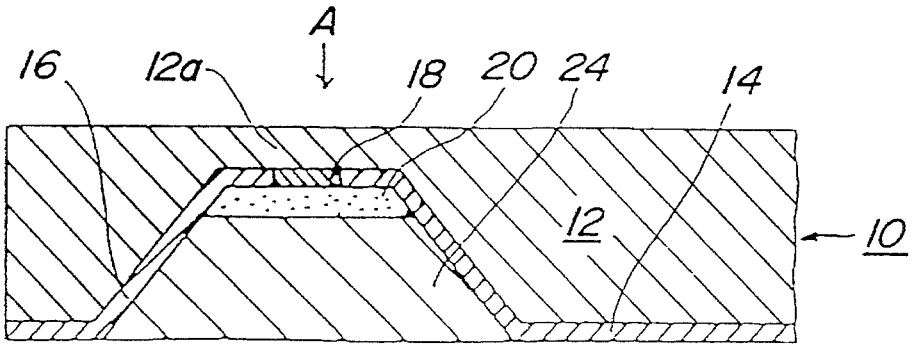
FIG. 5 is a sectional view of a thermal head according a fifth embodiment of the present invention.

Still further embodiments of the present invention are shown in FIGS. 3–5, wherein it is assumed that the ink ribbon film and the recording paper are maintained in a pressure sliding contact with the printing surface 12*a* of the thermal head under application of a pressure by a platen roller in the direction indicated by an arrow A.

In the embodiment shown in FIG. 3, the substrate 12 is similar to that shown in FIG. 1 and is further provided with a reinforcement member 20 comprising a porous ceramic material which is adhered to the inner side of the thin-walled portion of the substrate 12 for providing an improved mechanical strength. By such an arrangement, a thickness "d" of the thin-walled portion can be reduced to 0.05 mm or less, and it is thus possible to provide a further improved thermal response characteristic.

In the embodiment shown in FIG. 4, using the same type substrate 12 as in FIG. 2, a heat radiation member 22 which may be made of boron nitride is mounted in the groove on that side of the substrate 12 which is opposite to the printing surface. The heat radiation member 22 covers the resistance-heating element 18 with an air layer 24 for maintaining a gap "$d_1$" of 0.1 mm therebetween. Consequently, the heat which has been generated by the resistance-heating element 18 but not used for printing can be rapidly dispersed by the heat insulating effect of the air layer 24 in the gap and by the heat radiation effect of the heat radiating member 24. This serves to minimize undesired tailing and like even during a high speed printing, and to improve further the thermal response characteristic of the thermal head.

The embodiment shown in FIG. 5 uses the substrate 12 which incorporates the combined features of the embodiments of FIGS. 3 and 4 in that the resistance-heating element 18 is covered by a reinforcement member 20 made of glass fiber to provide an improved mechanical strength of the substrate 2, and a heat radiation member 24 made of metal is adhered of the thin-walled portion 12*a* of the substrate 12 to enhance the radiation of the residual heat in the resistance-heating element 18 through the reinforcement member 20.

A prototype of a recording device to be used in combination with the various embodiments of the thermal heads explained above has been prepared to carry out printing and copying evaluation tests. The evaluation tests revealed that the thermal head according to each embodiment provides a low power consumption, high printing and copying quality, a stable performance which can be maintained for a long period, and an extremely high reliability.

It will be appreciated from the foregoing detailed description that, in accordance with the present invention, a thin-walled printing section is provided on the substrate and the resistance-heating element is arranged at a location spaced from the printing surface of the printing section, without requiring the conventional protective surface layer. It is thus possible to produce the thermal head with a lower cost and a reduced process steps as compared to the prior art. Furthermore, the present invention makes it readily possible to realize a thermal characteristic which is optimum for thermal printing, as well as a high efficiency in terms of high printing/copying speed and low power consumption.

While the present invention has been explained above with reference to some specific embodiments, they were presented by way of examples only and various modifications may be made without departing from the scope of the claims.

We claim:

1. A thermal head comprising a substrate, a resistance-heating element formed on the substrate and adapted to be supplied with electrical power, said substrate comprising a material having a thermal conductivity coefficient within a range of 0.0025 to 0.030 cal·cm/sec·cm$^2$·°C. and a heat capacity per unit volume of not greater than 0.55 cal/°C.·cm$^3$, said substrate having a thin-walled portion which is formed with said resistance-heating element and which is thinner than remaining portions of the substrate, said substrate further having a printing surface relative to which an information carrier is caused to slide for printing information on the information carrier, said printing surface being integral with a substrate surface which is adjacent to the resistance-heating element.

2. The thermal head as claimed in claim 1, wherein the substrate material has a thermal conductivity coefficient which is not less than 0.003 cal·cm/sec·cm$^2$·°C.

3. The thermal head as claimed in claim 1, wherein the substrate material has a thermal conductivity coefficient which is not greater than 0.010 cal·cm/sec·cm$^2$·°C.

4. The thermal head as claimed in claim 1, wherein the substrate material has a heat capacity per volume of not greater than 0.53 cal/°C.cm$^3$.

5. The thermal head as claimed in claim 1, wherein the resistance-heating element is formed on that side of the substrate which is opposite side to the printing surface.

6. The thermal head as claimed in claim 1, wherein the substrate comprises a glass ceramic material.

7. The thermal head as claimed in claim 1, wherein the resistance-heating element is spaced from the printing surface of the substrate by a distance within a range of 0.02 to 0.3 mm.

8. The thermal head as claimed in claim 1, further comprising a reinforcement member provided along the thin-walled portion of the substrate.

9. The thermal head as claimed in claim 8, wherein the reinforcement member is arranged on the thin-walled portion of the substrate.

10. The thermal head as claimed in claim 8, wherein the reinforcement member has a shape which conforms to the thin-walled portion of the substrate.

11. The thermal head as claimed in claim 1, wherein a heat radiating means is provided adjacent to the resistance-heating element.

12. The thermal head as claimed in claim 10, wherein the heat radiating means comprises a heat radiation space.

13. The thermal head as claimed in claim 10, wherein the heat radiating means comprises a heat radiator.

14. The thermal head as claimed in claim 13, wherein the heat radiator is connected to the resistance-heating element through a reinforcement member.

15. The thermal head as claimed in claim 13, wherein the reinforcement member is provided along the thin-walled portion of the substrate.

16. The thermal head as claimed in claim 15, wherein the reinforcement member is arranged on the thin-walled portion of the substrate.

17. The thermal head as claimed in claim 15, wherein the reinforcement member has a shape which conforms to the thin-walled portion of the substrate.

* * * * *